US006880240B2

(12) United States Patent
Kitagawa et al.

(10) Patent No.: US 6,880,240 B2
(45) Date of Patent: Apr. 19, 2005

(54) CRIMPING DEVICE FOR CRIMPING CRIMP PIECES OF A METAL TERMINAL

(75) Inventors: Hironori Kitagawa, Shizuoka (JP); Naoki Ito, Shizuoka (JP); Tsutomu Takayama, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 340 days.

(21) Appl. No.: 09/795,367

(22) Filed: Mar. 1, 2001

(65) Prior Publication Data

US 2001/0018801 A1 Sep. 6, 2001

(30) Foreign Application Priority Data

Mar. 3, 2000 (JP) ..... P. 2000-059037

(51) Int. Cl.[7] ..... H01R 43/04
(52) U.S. Cl. ..... 29/753; 29/751; 72/409.12
(58) Field of Search ..... 29/751, 753, 760, 29/761, 861, 863, 748, 517, 33 M; 72/430, 466.3; 439/877, 865; 174/84 C, 94 R

(56) References Cited

U.S. PATENT DOCUMENTS

| | | | | | |
|---|---|---|---|---|---|
| 3,927,453 | A | | 12/1975 | Zahn et al. | 29/203 D |
| 4,067,105 | A | | 1/1978 | Zahn et al. | 29/628 |
| 4,598,570 | A | * | 7/1986 | Baldyga | 72/338 |
| 4,828,516 | A | * | 5/1989 | Shaffer | 439/877 |
| 5,101,651 | A | * | 4/1992 | Yeomans | 72/19 |
| 5,414,926 | A | * | 5/1995 | Ito et al. | 29/753 |
| 5,486,653 | A | | 1/1996 | Dohi | 174/84 C |
| 5,500,999 | A | | 3/1996 | Yagi et al. | 29/753 |
| 5,901,439 | A | | 5/1999 | Endo et al. | 29/863 |
| 2002/0189095 | A1 | * | 12/2002 | Ito et al. | 29/861 |

FOREIGN PATENT DOCUMENTS

| | | |
|---|---|---|
| DE | 83 14 090 U1 | 9/1983 |
| JP | 61-48681 | 4/1986 |

* cited by examiner

*Primary Examiner*—Minh Trinh
(74) *Attorney, Agent, or Firm*—Morgan Lewis & Bockius LLP

(57) ABSTRACT

Crimp pieces (21) of a metal terminal and a conductor wire placed on an inner side of the crimp pieces are positioned between a crimp indenter (11) and a crimp anvil (18). Then, at least one of the crimp indenter (11) and the crimp anvil (18) is moved toward another one thereof along a direction of a longitudinal center axis (12) to crimp the crimp pieces (21). At least two arch-shaped portions (13) are disposed on an inner surface of the crimp indenter (11), and are adjacent to each other and symmetric with respect to a plane including the longitudinal center axis (12). A sharply pointed portion (14) is defined by curves of the at least two arch-shaped portions (13) intersecting on the longitudinal center axis (12). Curvature of each of the curves is set to be greater toward the sharply pointed portion (14).

7 Claims, 7 Drawing Sheets

CRIMPING DEVICE FOR CRIMPING CRIMP PIECES OF A METAL TERMINAL

BACKGROUND OF THE INVENTION

1. Field of the Invention

The present invention relates to improvements of a crimping device for crimping crimp pieces of a metal terminal in which the improvement of electrical connection performance is made by increasing the mechanical clamp strength.

The present application is based on Japanese Patent Application No. 2000-059037, which is incorporated herein by reference.

2. Description of the Related Art

In a case where a covered wire is connected to a metal terminal by crimping, the covered wire with a covering at its tip portion peeled off is placed in such a manner as to be sandwiched between a pair of front legs and a pair of rear legs, respectively, which are crimp pieces of the metal terminal, and are crimped by a clamping motion of a crimping device, thereby making it possible to obtain electrical connection performance with predetermined mechanical strength.

For example, in a case where a female metal terminal 2 is crimped and fixed to a covered wire 1 shown in FIG. 5, a pair of front legs 3 of the female metal terminal 2 are clamped against a core strand 4 and a pair of rear legs 5 against a covered portion 6, respectively, thereby forming a conductor crimped portion 7 and a covering crimped portion 8. The metal terminal 2 with a wire thus obtained is used by being electrically connected by being inserted into an inserting portion of an unillustrated connector body.

The crimping of the crimp pieces of this metal terminal is effected by a crimping device shown in FIGS. 6A to 6C. Namely, the pair of curved front legs 3 are placed on a crimp anvil 9, and the core strand 4 is placed in it (FIG. 6A). Meanwhile, a crimp indenter 10 (hereafter referred to as the "crimper") has two arch-shaped portions which are bilaterally symmetrical, and each of the arch-shaped portions has a curved surface formed continuously with two different radii of curvatures R1 and R2. As this crimper 10 is lowered, the conductor crimped portion 7 such as the one shown in FIG. 6B is formed by clamping.

However, since the radius of curvature R1 is smaller than the radius of curvature R2, when the front legs 3 are crimped, a component of force FX of a crimping force F, which is larger than a component of force FY thereof, is applied to a tip of each of the front legs 3 in a mutually interfering direction, as shown in FIG. 6C. For this reason, the force FY with which the tips of the front legs bite into the core strand 4 becomes weak correspondingly, and it becomes difficult to obtain predetermined clamp strength, thereby possibly causing a decline in the reliability of electrical connection correspondingly.

This also applies to a case in which, as shown in FIGS. 7A to 7C, the inner surface of the crimper 10 is formed with a single radius of curvature R3, the component of force FX larger than the component of force FY is applied to the tip of each of the front legs 3, as shown in FIG. 7C. For this reason, since this component of force FX acts in the direction in which the two tips interfere with each other, the biting into the core strand 4 becomes shallow in the same way as FIGS. 6A to 6C, possibly leading to the impairment of the reliability.

SUMMARY OF THE INVENTION

The present invention has been devised with a view to overcoming the drawbacks of the related device, and an object of the present invention is to provide a crimping device for crimping crimp pieces of a metal terminal wherein when the crimp pieces of the metal terminal are formed by the crimping device, the interference of the tips of the front legs, which are free ends, is suppressed to a minimum to deepen the biting into the core strand, thereby enhancing the crimping performance, i.e., the electrical connection performance.

To achieve the above object, according to a first aspect of the present invention, there is provided a crimping device which comprises a crimp indenter; a crimp anvil, wherein crimp pieces of a metal terminal and a conductor wire placed on an inner side of the crimp pieces are positioned between the crimp indenter and the crimp anvil, and wherein at least one of the crimp indenter and the crimp anvil is movable toward another one thereof along a direction of a longitudinal center axis of the crimp indenter and the crimp anvil to crimp the crimp pieces of the metal terminal; at least two arch-shaped portions disposed on an inner surface of the crimp indenter, the at least two arch-shaped portions being adjacent to each other and symmetric with respect to a plane including the longitudinal center axis; and a sharply pointed portion defined by curves of the at least two arch-shaped portions intersecting on the longitudinal center axis, wherein curvature of each of the curves is set to be greater toward the sharply pointed portion.

As the relative movement of the crimp indenter and the crimp anvil advances, the crimp pieces of the metal terminal are curved at the arch-shaped portions. In addition, since the curvature of the arch-shaped portions in the vicinity of the sharply pointed portion on the longitudinal center axis is formed to be large, when free ends of the two crimp pieces in the vicinity of the sharply pointed portion face each other and converge, the force oriented toward the conductor wire becomes larger than the force acting in the mutually interfering and abutting direction. For this reason, the clamping force at the conductor crimped portion becomes large, and the mechanical coupling strength is increased.

According to a second aspect of the present invention, it is preferable that the curvature of each of the curves is formed so as to define a first circular-arc portion having a small curvature, and a second circular-arc portion, which continues from the first circular-arc portion, and whose curvature becomes greater toward the sharply pointed portion.

If the crimp indenter is relatively moved so as to approach the crimp anvil, the force acting on the two free end of the crimp pieces of the metal terminal in the mutually interfering direction becomes small, and the biting force of the free ends with respect to the conductor wire becomes large.

According to a third aspect of the present invention, it is preferable that centers of radius of curvature of the first circular-arc portion and the second circular-arc portion are set to be present on a straight line, which is parallel with the longitudinal center axis, and which crosses the curves.

Accordingly, it is possible to obtain a conductor crimped portion of the metal terminal having uniform clamp strength by virtue of the crimp indenter having excellent dimensional accuracy of machining.

According to a fourth aspect of the present invention, it is preferable that at least one of an angular portion and a rounded portion is formed by chamfering both edges of the inner surface of the crimp indenter including the at least two arch-shaped portions.

Accordingly, in case of crimp pieces of the metal terminal having a small thickness, impressions, scars, and the like, which are disadvantageous in terms of the mechanical strength, do not occur.

BRIEF DESCRIPTION OF THE DRAWINGS

FIGS. 2A–2C are enlarged views of an essential portion at a portion IIA in FIG. 1A, in which FIG. 2A is a front elevational view, and FIGS. 2B and 2C are cross-sectional views taken in the direction of arrows IIB—IIB in FIG. 2A;

FIGS. 3A and 3B are explanatory diagrams of fabrication for explaining a state in which the crimp pieces of the metal terminal are fabricated by using the crimper shown in FIG. 2A, in which FIG. 3A is a cross-sectional view of the state during an early period of pressurization by the crimper, and FIG. 3B is a cross-sectional view of the state at the point of time of completion of pressurization;

FIG. 6A to 6C are explanatory diagrams illustrating the fabrication of a conductor crimped portion in a related device, in which FIG. 6A is a cross-sectional view in the stage of an early period of pressurization by the crimper, FIG. 6B is a cross-sectional view at the point of time of completion of pressurization, and FIG. 6C is an enlarged cross-sectional view of a portion A in FIG. 6B; and FIGS. 7A to 7C are explanatory diagrams illustrating the fabrication of a conductor crimped portion in another related device, in which FIG. 7A is a cross-sectional view in the stage of an early period of pressurization by the crimper, FIG. 7B is a cross-sectional view at the point of time of completion of pressurization, and FIG. 7C is an enlarged cross-sectional view of a portion A in FIG. 7B.

DETAILED DESCRIPTION OF THE PREFERRED EMBODIMENTS

Preferred embodiments of the present invention now will be described with reference to FIGS. 1A to 5.

Figure 1A:
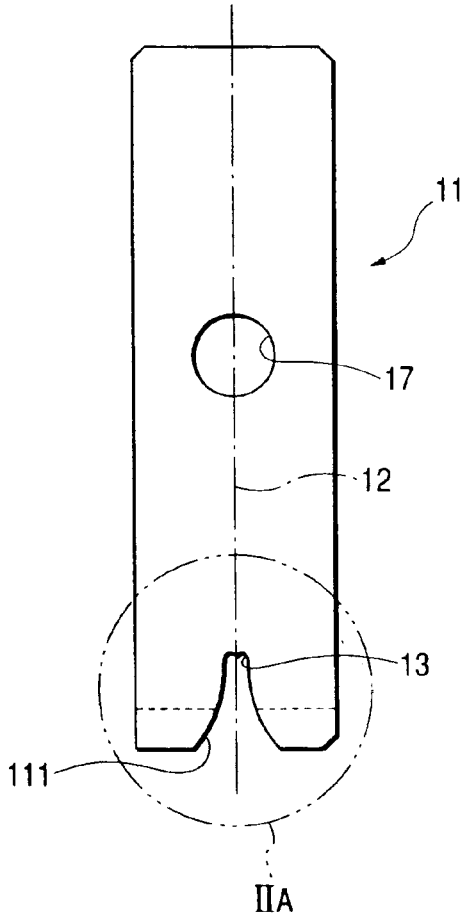
FIG. 1A is a front elevational view of a crimp indenter, i.e., a crimper, of a crimping device for crimping crimp pieces of a metal terminal in accordance with an embodiment of the present invention.
Figure 1B:
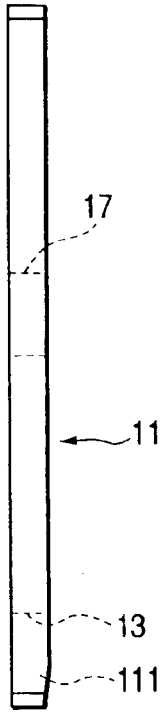
FIG. 1B is a side elevational view of the crimper shown in FIG. 1A.
Figure 2B:
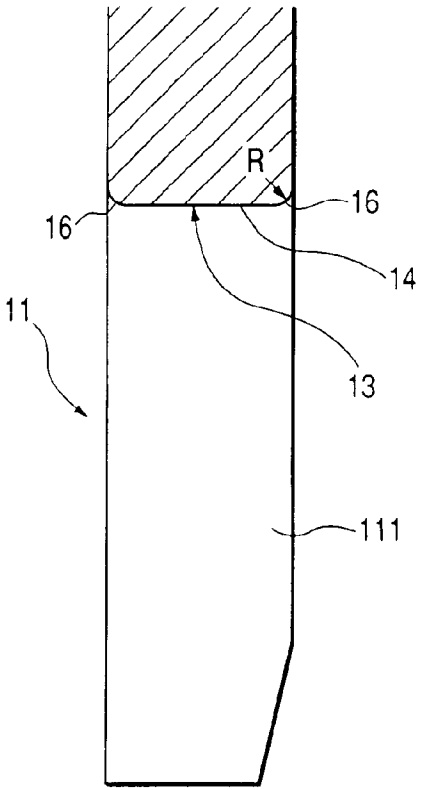
Figure 2A:
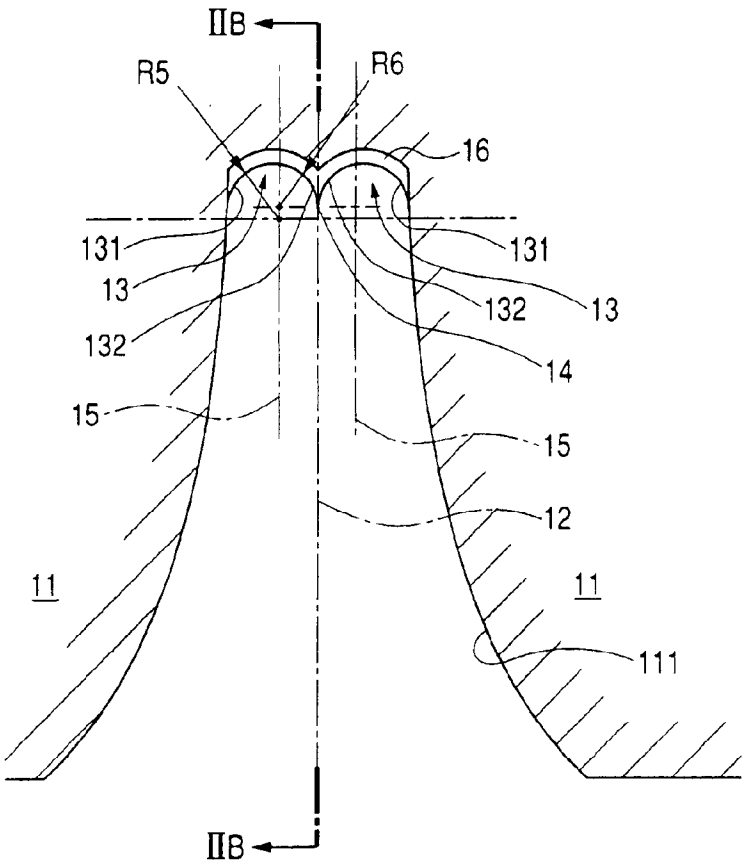
Figure 2C:
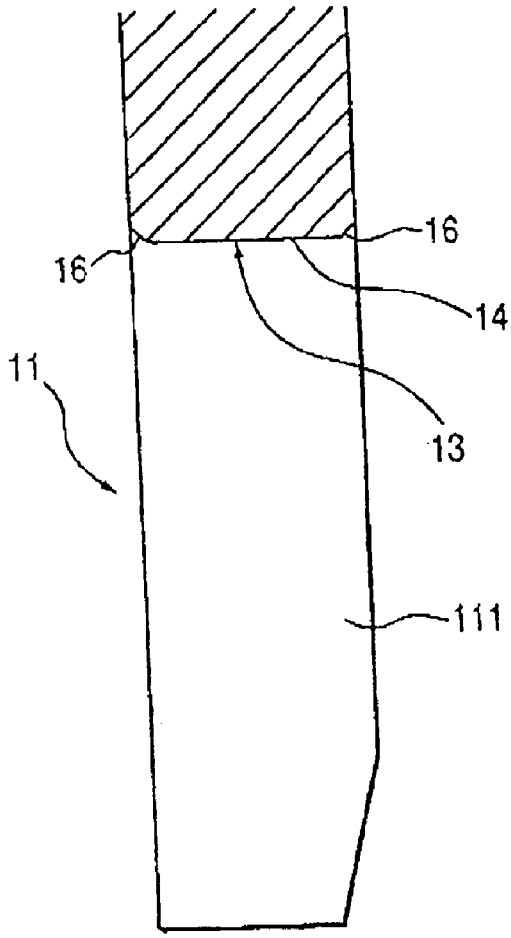

FIG. 1A is a front elevational view of a crimp indenter, i.e., a crimper 11, and FIG. 1B is a side elevational view thereof. The crimper 11 is a component element of a crimping device for crimping crimp pieces of a metal terminal, and two arch-shaped portions 13 are formed on an inner surface, corresponding to an apex, of a chevron-shaped groove 111 of the crimper 11 in such a manner as to be adjacent to each other and symmetric with respect to a plane including a longitudinal center axis 12 of the crimper. The curves which form the arch-shaped portions intersect on the longitudinal center axis, and a point of their intersection forms a sharply pointed portion 14. Reference numeral 15 denotes a parallel straight line which is parallel with the longitudinal center axis 12 and which passes vertically across the apex portion of the arch-shaped portion 13. In addition, this curve is comprised of a first circular-arc portion 131 having a large radius of curvature R5 and a second circular-arc portion 132 continuing therefrom and continuing to the sharply pointed portion 14 and having a smaller radius of curvature R6 than the first circular-arc portion 131. The center of each radius of curvature for forming each circular arc-portion is set to be present on the parallel straight line 15.

Reference numeral 16 denotes an angular portion formed by chamfering an edge portion of the inner surface forming the arch-shaped portion 13 of the crimper 11. It should be noted that reference numeral 17 denotes an attaching hole for attaching the crimper 11 to an unillustrated main body of the crimping device.

A description will be given of the operation of this embodiment.

Figure 3A:
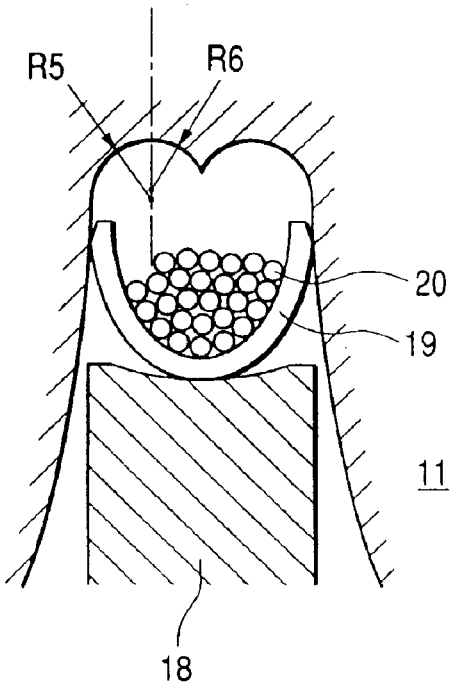
Figure 3B:
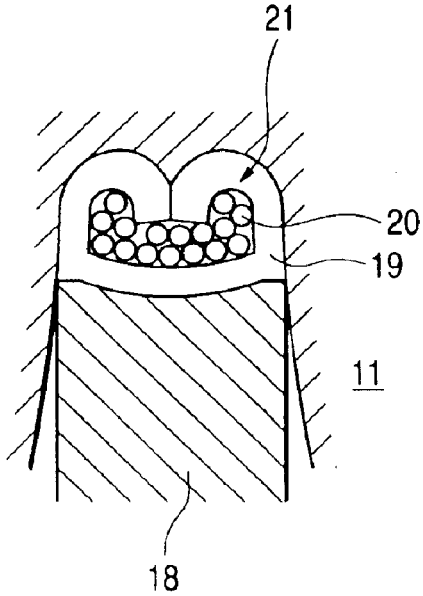

In FIGS. 3A and 3B, the crimp indenter, i.e., crimper, 11 and a crimp anvil 18 are set in the unillustrated main body of the crimping device. A pair of curved front legs 19 of the female metallic terminal are mounted on the crimp anvil 18. A core strand 20 of the covered wire is placed on the front legs 19. Next, the crimper 11 is moved toward the crimp anvil 18 (FIG. 3A). Further, the crimper 11 is moved downward, so that the front legs 19 are pressed by the crimp indenter 11 and the crimp anvil 18, as shown in FIG. 3B.

Namely, both free ends of the front legs 18 are slid along the inner surface of the crimper 11, and are each curved along the first circular-arc portion 131 and then along the second circular-arc portion 132 of the arch-shaped portion 13. Although the two free ends face and interfere with each other at the sharply pointed portion 14, the two free ends are displaced in the direction of biting toward the core strand 20 in a state in which their backs are in contact with each other. Thus the core strand 20 is clasped and clamped by the front legs 19, thereby forming a conductor crimped portion 21.

Figure 4:
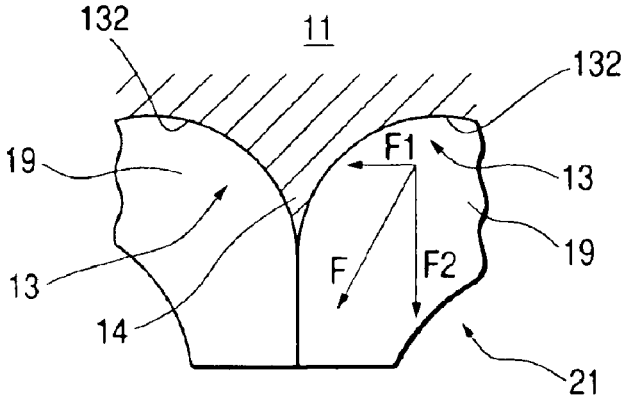
FIG. 4 is a cross-sectional view of an essential portion for explaining the clamping force which is applied to free ends of the crimp pieces of the metal terminal at a sharply pointed portion of the crimper.
Figure 5:
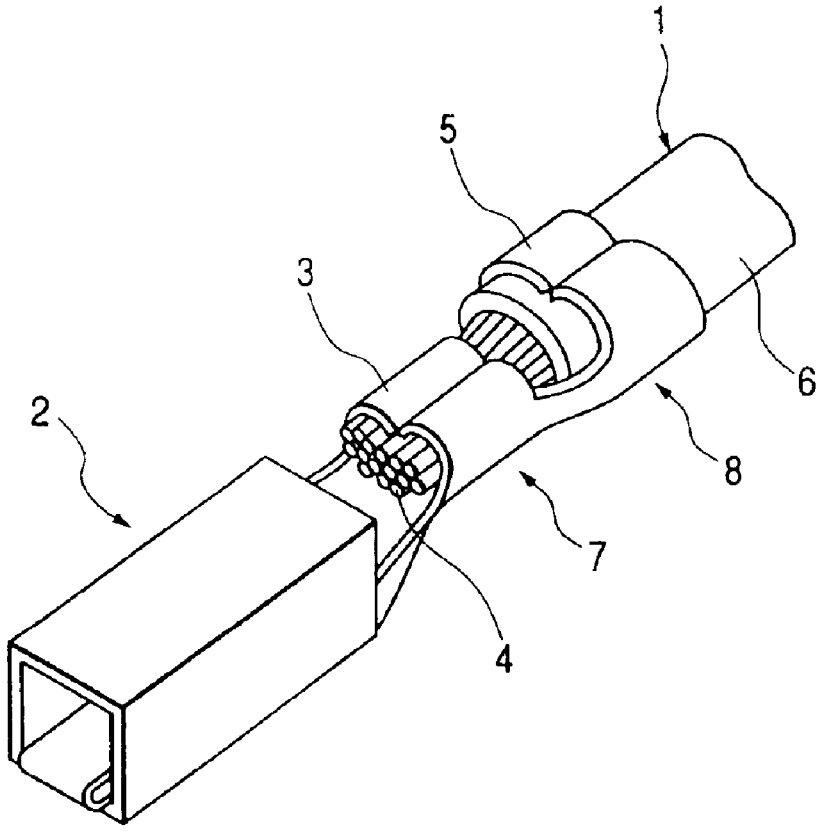
FIG. 5 is an external perspective view illustrating a state in which a covered wire is joined to a female metal terminal by clamping.
Figure 6A:
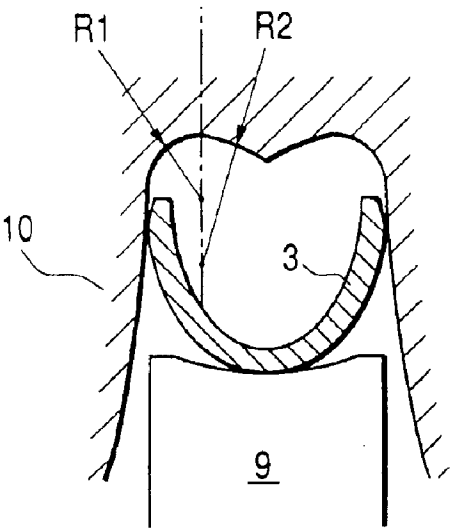
Figure 6B:
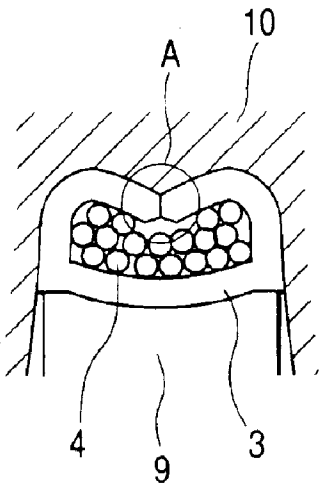
Figure 6C:
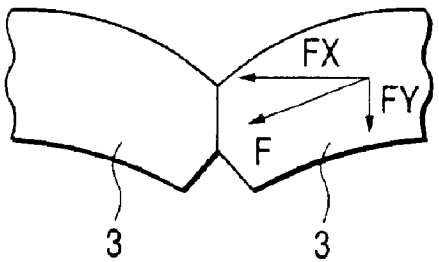
Figure 7A:
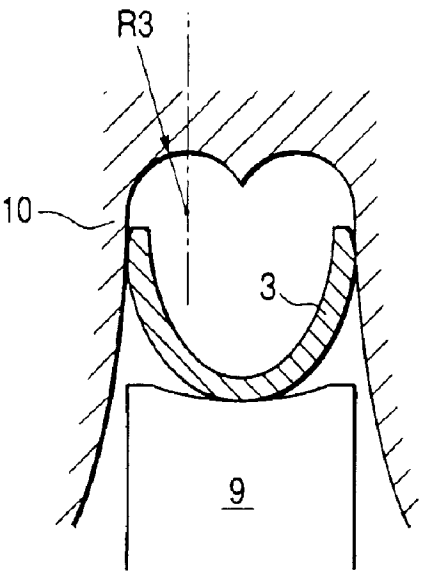
Figure 7B:
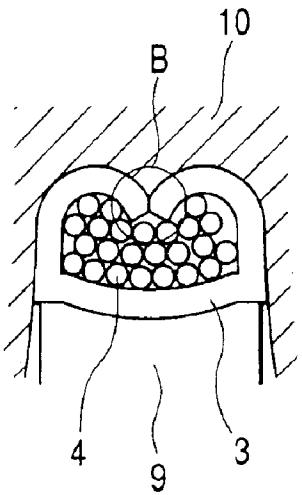
Figure 7C:
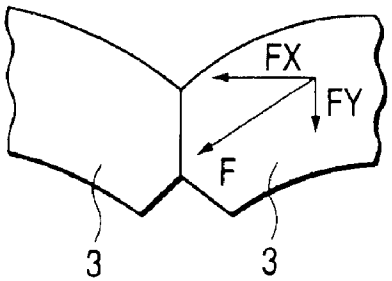

At this time, although, as shown in FIG. 4, a force F is applied to the free ends when the two free ends converge at the sharply pointed portion 14 and abut against each other, if this force is decomposed, a force F1 acting in the mutually interfering direction and a force F2 tending to bite toward the strand 20 side act. However, since the vicinity of each free end is curved at the second circular-arc portion 132 such that the curvature becomes large, the interfering force F1 is smaller than the force FX of the related device corresponding thereto, and therefore the component of force F2 tending to bite toward the core strand 20 becomes large.

Thus, in accordance with this embodiment, since the interfering force applied to the free ends of the front legs 19 can be reduced at the time of crimping the terminal, the biting into the core strand can be made deeper correspondingly. In consequence, the clamp strength, i.e., the mechanical coupling strength, in the conductor crimped portion 21 can be increased, so that it is possible to appreciably improve the crimping performance, i.e., electrical connection performance.

Although the embodiment has been described specifically, the specific arrangement is not limited to this embodiment, and it is to be understood that even if design changes or the like are made within the scope which does not depart from the gist of the present invention, such design changes or the like are included in the present invention.

For example, although in the foregoing embodiment a description has been given of the case in which the conductor crimped portion 21 (7 in FIG. 5) is formed by using the female metal terminal having a quadrangular terminal portion at its tip, the present invention can be also applied, as required, to a terminal other than the terminal of this form, i.e., a male metal terminal, namely, a metal terminal of the form in which its terminal portion has a bolt hole into which a bolt is merely inserted.

In addition, although the crimp pieces of the metal terminal making up the conductor crimped portion have been described as being the front legs 19, the crimp pieces are not limited to the front legs, and may be applied to the crimping of the rear legs where the wire is covered. Further, the present invention can be applied to a form in which the front legs and the rear legs are both crimped onto the core strand by clamping, and to a form in which the front and rear legs are not separated but form a continuous pair of legs.

Further, although a description has been given of a bare wire, the present invention is also applicable to a bare wire.

In addition, although in the above description the arch-shaped portion 13 is formed by the first and second circular-arc portions 131 and 132, a form may be adopted in which the arch-shaped portion 13 are continuously formed by a greater number of circular-arc portions such that the curvature becomes greater toward the sharply pointed portion 14.

In addition, although the centers of the radii of curvature R5 and R6 of the two circular-arc portions 131 and 132 are set to be located on the parallel straight line 15, it goes without saying that this parallel straight line 15 need not pass the apex portion of the arch-shaped portion.

As described above, in accordance with the first aspect of the present invention, as the crimp indenter is relatively moved so as to approach the crimp anvil, the free ends of the legs of the metal terminal, which make up the crimp pieces of the metal terminal, are curved and deformed along the shape of the arch-shaped portions in the initial period of the relative movement, and the curvature of the arch-shaped portions is formed so as to be greater toward the sharply pointed portion in the final period of the relative movement. Accordingly, with respect to the free ends of the two legs which have collided against each other at the sharply pointed portion, the force tending to bite toward the conductor wire becomes larger than the force acting in the direction of interfering the mutually opposing legs. For this reason, the clamp strength of the conductor crimped portion with respect to the conductor wire can be increased appreciably, so that an operational advantage is offered in that it is possible to obtain a crimping device for crimping crimp pieces of a metal terminal excelling in the crimping performance and, hence, the electrical connection performance.

In accordance with the second aspect of the present invention, as the crimp indenter is relatively moved so as to approach the crimp anvil, the free ends of the legs of the metal terminal, which make up the crimp pieces of the metal terminal, are curved by the first circular-arc portion having a small curvature in the initial period of the relative movement, and are subsequently curved by the second circular-arc portion having a greater curvature as the relative movement further progresses. For this reason, with respect to the two free ends which have faced each other by being pressed at the sharply pointed portion (which is also a portion of the second circular-arc portion), the force tending to bite toward the conductor wire becomes larger than the force acting in the direction of interfering the mutually opposing legs. For this reason, the clamp strength of the conductor crimped portion with respect to the conductor wire can be increased appreciably, so that an operational advantage is offered in that it is possible to obtain a crimping device for crimping crimp pieces of a metal terminal excelling in the crimping performance and, hence, the electrical connection performance.

In addition, in accordance with the third aspect of the present invention, in addition to the above-described operational advantages, since the centers of the radius of curvature of the first circular-arc portion and the second circular-arc portion are set to be present on the straight line which is parallel with the longitudinal axis and which crosses the curve of the crimp indenter, the curving and deformation of the crimp pieces of the metal terminal can be effected smoothly. Therefore, an advantage is offered in that it is possible to form a conductor crimped portion excelling in dimensional accuracy of machining and having uniform clamp strength.

In accordance with the fourth aspect of the present invention, since an angular portion or a rounded portion is formed by chamfering both edges of the inner surface of the crimp indenter including the arch-shaped portions thereof, in the case of crimp pieces of the metal terminal having a small thickness, impressions, scars, and the like, which are disadvantageous in terms of the mechanical strength, do not occur. Accordingly, an advantage is offered in that it is possible to obtain electrical connections excelling in reliability without causing a decline in the clamp strength of the crimp pieces of the metal terminal.

What is claimed is:

1. A crimping device, comprising:

a crimp indenter;

a crimp anvil, wherein crimp pieces of a metal terminal and a conductor wire placed on an inner side of the crimp pieces are positioned between the crimp indenter and the crimp anvil, and wherein at least one of the crimp indenter and the crimp anvil is movable toward one another along a direction of a longitudinal center axis of the crimp indenter and the crimp anvil to crimp the crimp pieces of the metal terminal;

at least two arch-shaped portions disposed on an inner surface of the crimp indenter, the at least two arch-shaped portions being adjacent to each other and symmetric with respect to the longitudinal center axis and originating at longitudinal guide walls of the inner surface of the crimping indenter; and a sharply pointed portion defined by curves of the at least two arch-shaped portions intersecting on the longitudinal center axis at center ends of the at least two arch-shaped portions, wherein each of the curves has a curvature set to be greater toward the sharply pointed portion than toward the longitudinal guide walls.

2. The crimping device of claim 1, wherein the curvature of each of the curves is formed so as to define:

a first circular-arc portion having a first curvature, and a second circular-arc portion, which continues from the first circular-arc portion toward the sharply pointed portion, said second circular arc portion having a second curvature greater than the first curvature.

3. The crimping device of claim 2, wherein centers of radius of curvature of the first circular-arc portion and the second circular-arc portion are set to be present on a straight line, which is parallel with the longitudinal center axis, and which crosses the curves.

4. The crimping device of claim 3, wherein a portion of at least one edge of the inner surface of the crimp indenter including the at least two arch-shaped portions is chamfered.

5. The crimping device of claim 3, wherein the radius of curvature of the first circular-arc portion is larger than the radius of curvature of the second circular-arc portion.

6. The crimping device of claim 4, wherein the at least one edge is chamfered in an angular shape.

7. The crimping device of claim 4, wherein the at least one edge is chamfered in an rounded shape.

* * * * *